US010244584B2

(12) United States Patent
Fattorini et al.

(10) Patent No.: US 10,244,584 B2
(45) Date of Patent: Mar. 26, 2019

(54) METHOD FOR CONTROLLING AN INDUCTION COOKING HOB WITH A PLURALITY OF INDUCTION COILS AND AN INDUCTION COOKING HOB

(71) Applicant: Electrolux Home Products Corporation N. V., Brussels (BE)

(72) Inventors: Andrea Fattorini, Forli (IT); Svend Erik Christiansen, Forli (IT); Laurent Jeanneteau, Forli (IT); Thibaut Rigolle, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 735 days.

(21) Appl. No.: 14/432,340

(22) PCT Filed: Nov. 7, 2013

(86) PCT No.: PCT/EP2013/073262

§ 371 (c)(1),
(2) Date: Mar. 30, 2015

(87) PCT Pub. No.: WO2014/072401

PCT Pub. Date: May 15, 2014

(65) Prior Publication Data

US 2015/0245417 A1 Aug. 27, 2015

(30) Foreign Application Priority Data

Nov. 9, 2012 (EP) ..... 12191955

(51) Int. Cl.
*H05B 6/06* (2006.01)
*H05B 6/44* (2006.01)

(52) U.S. Cl.
CPC ..... *H05B 6/065* (2013.01); *H05B 6/44* (2013.01); *H05B 2213/03* (2013.01)

(58) Field of Classification Search
CPC ..... H05B 6/44; H05B 6/065; H05B 2213/03
(Continued)

(56) References Cited

U.S. PATENT DOCUMENTS 6,614,006 B2 * 9/2003 Pastore ..... H05B 3/746 219/447.1
6,693,262 B2 * 2/2004 Gerola ..... H05B 3/74 219/462.1

(Continued)

FOREIGN PATENT DOCUMENTS

CN 101208994 A 6/2008
CN 101766051 A 6/2010

(Continued)

OTHER PUBLICATIONS

International Search Report for PCT/EP2013/073262, dated Dec. 17, 2013, 3 pages.

(Continued)

*Primary Examiner* — Ibrahime A Abraham
*Assistant Examiner* — John J Norton
(74) *Attorney, Agent, or Firm* — Pearne & Gardon LLP

(57) ABSTRACT

A method for controlling a cooking hob with one or more induction coils covered by a cookware and forming a cooking zone. All induction coils of the cooking zone are alternately activated. The method includes setting an average power to be transferred to the cookware by a user, determining a frequency, estimating a maximum average power if all induction coils of the cooking zone would be activated with said frequency, estimating a percentage power defined as quotient between the set average power and the estimated maximum average power, estimating a calculated number of coils defined as product of the number of coils within the cooking zone and the percentage power, defining a minimum number of simultaneously activated (Continued)

coils within the cooking zone by an integer value of the calculated number, and defining a temporal activation of a further one of the coils by a fractional part of the calculated number.

14 Claims, 1 Drawing Sheet

(58) Field of Classification Search
USPC ..... 219/621, 662
See application file for complete search history.

(56) References Cited

U.S. PATENT DOCUMENTS

| | | | | |
|---|---|---|---|---|
| 6,870,138 | B2 * | 3/2005 | Pastore | H05B 3/746 219/446.1 |
| 6,930,287 | B2 * | 8/2005 | Gerola | H05B 3/746 219/446.1 |
| 7,423,244 | B2 * | 9/2008 | Baier | H05B 6/062 219/624 |
| 7,425,690 | B2 * | 9/2008 | Schilling | H05B 3/746 219/451.1 |
| 7,759,616 | B2 * | 7/2010 | Gouardo | H05B 6/065 219/445.1 |
| 8,558,148 | B2 * | 10/2013 | Artigas Maestre | H05B 6/065 219/626 |
| 9,006,621 | B2 * | 4/2015 | Artal Lahoz | H05B 6/065 219/622 |
| 2012/0024835 | A1 * | 2/2012 | Artal Lahoz | H05B 6/065 219/385 |
| 2013/0284722 | A1 * | 10/2013 | Viroli | H05B 6/065 219/622 |

FOREIGN PATENT DOCUMENTS

| | | | | |
|---|---|---|---|---|
| CN | 102612855 | A | 7/2012 | |
| EP | 1303168 | A1 | 4/2003 | |
| EP | 1951003 | A1 | 7/2008 | |
| EP | 2177076 | A1 | 4/2010 | |
| EP | 2328384 | A1 | 6/2011 | |
| WO | 2005069688 | A2 | 7/2005 | |
| WO | WO 2005069688 | A2 * | 7/2005 | H05B 6/065 |
| WO | 2009016124 | A1 | 2/2009 | |
| WO | WO 2009016124 | A1 * | 2/2009 | H05B 6/065 |
| WO | WO 2012098193 | A1 * | 7/2012 | H05B 6/065 |

OTHER PUBLICATIONS

Search Report for counterpart Chinese Patent Application No. 201380050367.8, dated Mar. 9, 2016, 2 pages.

* cited by examiner

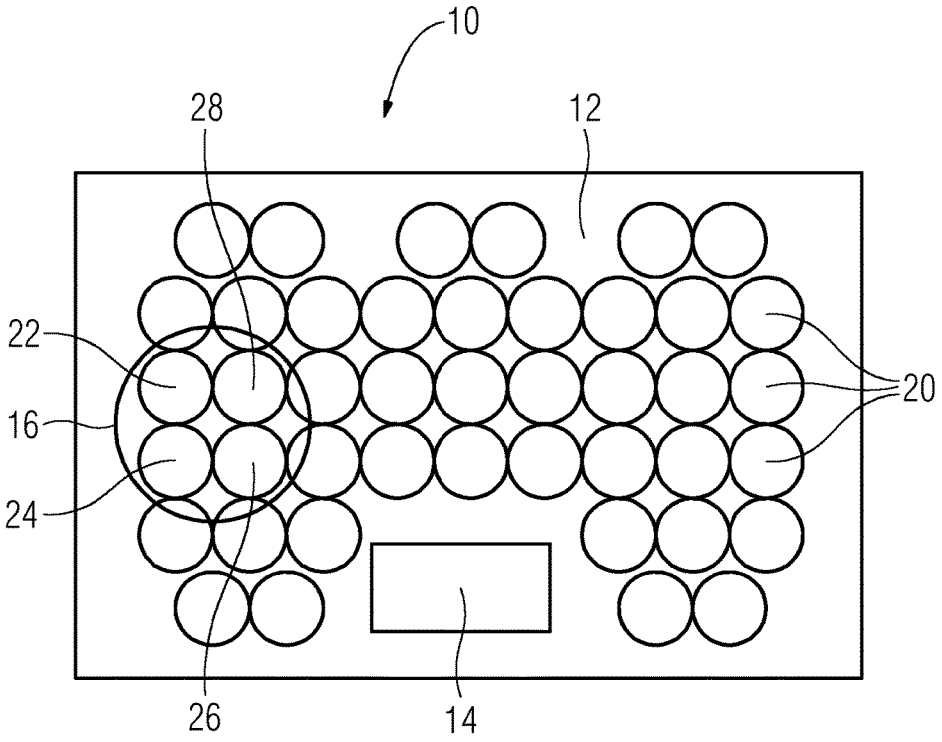
10
28
12
22
16
24
20
26
14

METHOD FOR CONTROLLING AN INDUCTION COOKING HOB WITH A PLURALITY OF INDUCTION COILS AND AN INDUCTION COOKING HOB

The present invention relates to a method for controlling an induction cooking hob with a plurality of induction coils according to the preamble of claim 1. Further, present invention relates to an induction cooking hob with a plurality of induction coils according to the preamble of claim 9.

An induction cooking hob includes a plurality of induction coils. The induction coils are arranged below a cooking surface. For example, the cooking surface is formed by a glass ceramic panel. The induction coils are arranged as a matrix below the glass ceramic panel. Typically, a standard size cookware covers multiple induction coils. The power transferred to the cookware has to be controlled. The induction coils covered by the same piece of cookware are grouped together into a zone-group. A detection system identifies those induction coils, which are covered by the same cookware.

Adjacent induction coils generate interference between each other, if their frequencies are different. This may result in an audible noise, if the difference between the frequencies is in the audible range. The induction coils of the same zone-group are powered by the same frequency. However, adjacent zone-groups may have different frequencies in order to obtain different powers.

WO 2005/069688 A2 discloses a method for controlling heating elements of a subarea on a cooking hob. The power of each heating element is released with discrete power stages. Some heating elements are operated at maximum power, while one heating element is operated in a clocked mode. The remaining heating elements are deactivated.

It is an object of the present invention to provide an improved method for controlling an induction cooking hob with a plurality of induction coils and a corresponding induction cooking hob, which overcomes the problem of interference.

The object of the present invention is achieved by the method according to claim 1.

According to the present invention the method comprises the further steps of:

- estimating a percentage power defined as quotient between the set average power and the estimated maximum average power, and
- estimating a calculated number of induction coils defined as product of the number of induction coils within the cooking zone and the percentage power,
- wherein a minimum number of simultaneously activated induction coils within the cooking zone is defined by an integer value of the calculated number,
- and wherein a temporal activation of a further one of the induction coils is defined by a fractional part of the calculated number,
- and wherein the determined frequency depends on the cooking zone with the highest set power on the induction cooking hob.

The core of the present invention is the operation of the induction cooking hob at a determined frequency, wherein the power of the cooking zone is controlled by activating and deactivating the induction coils of said cooking zone. The maximum average power corresponds with the determined frequency. Said maximum average power occurs then, if all induction coils of the cooking zone would be activated with said frequency. The integer value of the calculated number defines the minimum number of simultaneously activated induction coils within the cooking zone. The fractional part of the calculated number defines the temporal activation of the further one of the induction coils. The determined frequency depends on the cooking zone with the highest set power on the induction cooking hob.

Preferably, the induction coils of the cooking zone are activated and deactivated according to a time schedule including a plurality of subsequent cycles, wherein each cycle corresponds with a combination of activated induction coils.

In particular, during the cycle at least the minimum number of simultaneously activated induction coils is really activated.

In a similar way, during the cycle at most the minimum number of simultaneously activated induction coils and the further one of the induction coils is really activated.

Further, the number of cycles with the further one of the induction coils and the number of cycles without the further one of the induction coils may correspond with the fractional part of the calculated number.

Preferably, the time of a cycle following another cycle with the same number of activated induction coils is between 0.3 s and 0.6 s.

However, the time of a cycle following another cycle with a different number of activated induction coils may be between 1.2 s and 1.8 s, preferably 1.5 s.

Further, in subsequent cycles with the same number of activated induction coils the activated induction coils may be cyclically interchanged. This contributes to an even power distribution.

The present invention relates further to an induction cooking hob with a plurality of induction coils, wherein one or more induction coils are covered by a cookware and form a cooking zone, and wherein all induction coils of said cooking zone are at least alternately activated, wherein the induction cooking hob is provided for method mentioned above.

Preferably, the induction coils are arranged as a matrix on a cooking surface of the induction cooking hob.

In particular, the induction coils on the cooking surface of the induction cooking hob have the same sizes.

Novel and inventive features of the present invention are set forth in the appended claims.

The present invention will be described in further detail with reference to the drawing, in which FIG. 1 illustrates a schematic top view of an induction cooking hob according to a preferred embodiment of the present invention.

FIG. 1 illustrates a schematic top view of an induction cooking hob 10 according to a preferred embodiment of the present invention.

The induction cooking hob 10 comprises a cooking surface 12 and a user interface 14. The user interface 14 may be a touch-key panel or a touch screen. The induction cooking hob 10 comprises a control unit, which is not explicitly shown in FIG. 1. The control unit is electrically connected to the user interface 14. A cookware 16 is put on the cooking surface 12. The cookware 16 may be a pot or pan.

A plurality of induction coils 20 is arranged below the cooking surface 12. The induction coils 20 are arranged as a matrix. The induction coils 20 are relative small. In this example, the induction coils 20 have the same diameters. Further, the induction coils 20 of this embodiment have a diameter of about 70 mm in each case.

In this example, the induction cooking hob 10 comprises 43 induction coils 20 at all. A first front line of the matrix comprises four serial induction coils 20, wherein said first front line is interrupted by the user interface 14. A second front line of the matrix comprises six serial induction coils 20, wherein said second front line is also interrupted by the user interface 14. Three lines in a central portion of the cooking surface 12 comprise nine serial induction coils 20 in each case. A rear line of the matrix comprises six serial induction coils 20.

The cookware 16 shown in FIG. 1 covers four induction coils 20, namely a first induction coil 22, a second induction coil 24, a third induction coil 26 and a fourth induction coil 28. The induction coils 22, 24, 26 and 28 below the cookware 16 are the same as the other induction coils 20, but they are denoted by special reference numbers. The induction coils 22, 24, 26 and 28 below the cookware 16 form a cooking zone. In other words, the cooking zone includes the induction coils 22, 24, 26 and 28 covered by the same cookware 16.

The power transferred to the cookware 16 is adjustable by varying the frequency of the induction coils 22, 24, 26 and 28. Typically, the frequency is between 18 kHz and 60 kHz, wherein the highest frequency provided the lowest power. In general, the frequencies of the induction coils 20 are higher than the audible frequencies of the human ear. Otherwise, the currents in the induction coils 20 would stimulate physical movements resulting in audible noise. Further, different frequencies of adjacent inductions coils 20 would cause audible noise at the frequency difference.

The induction coils 20 of adjacent cooking zones are running at the same frequency in order to prevent interference and audible noise. In a similar way, the induction coils 22, 24, 26 and 28 below the cookware 16 are also running at the same frequency in order to prevent interference and audible noise. The frequency depends on the cooking zone with the highest set power on the cooking hob 10. The variation of the frequency cannot be used to vary the power of the cooking zone. The power of the cooking zone is adjusted by switching on and off the induction coils 22, 24, 26 and 28 below the cookware 16 according to a predetermined time schedule.

The table below shows an example of the time schedule for activating and deactivating the induction coils 22, 24, 26 and 28 below the cookware 16. The time schedule includes a number of subsequent cycles. During each cycle only a part of the induction coils 22, 24, 26 and 28 below the cookware 16 is activated. The activated induction coils 22, 24, 26 and 28 are denoted by x.

| number of cycle | first induction coil 22 | second induction coil 24 | third induction coil 26 | fourth induction coil 28 |
|---|---|---|---|---|
| 0 | x | x | x | |
| 1 | | x | x | x |
| 2 | | | x | x |
| 3 | x | | | x |
| 4 | x | x | | |
| 0 | | x | x | x |
| 1 | x | | x | x |
| 2 | x | | | x |
| 3 | x | x | | |
| 4 | | x | x | |

In the first cycle 0 the three induction coils 22, 24 and 26 are activated. During the second cycle 1 the three induction coils 24, 26 and 28 are activated. In the third cycle 2 only two induction coils 26 and 28 are activated. During the fourth cycle 3 the both induction coils 22 and 28 are activated. In the fifth cycle 4 the two induction coils 22 and 24 are activated.

During the next group of the five cycles 0, 1, 2, 3 and 4 the same scheme is performed, wherein the second induction coil 24 plays now the same role of the first induction coils 22 before. In a similar way, the third induction coil 26 plays now the same role of the second induction coils 24 before, and so on. In other words, the activated induction coils 22, 24, 26 and 28 are rotating counter-clockwise. The activation and deactivation of the induction coils 22, 24, 26 and 28 allow the adjusting of the set power, wherein the same frequency is maintained.

In the above example, the power regulation is performed by reducing the activated induction coils 20 with the cooking zone. The activated induction coils 20 are rotated around the complete number of induction coils 20 covered by the cookware 16, so that an even power distribution at the bottom of the cookware 16 is obtained. Since the rotation of the activated induction coils 20 does not create any flicker, the activation and deactivation of the induction coils 20 may be relative fast. For example, the time of one cycle may be 0.3 s to 0.6 s. In this case no significant boil-up and boil-down effect occurs.

The power of one induction coil 20 is variable between 50 W and 500 W. Typically, the cookware may cover between two and eight induction coils 20.

In the above example, the number of activated induction coils 20 during the first and second cycle is three, while during the third, fourth and fifth cycle the number of activated induction coils 20 is only two. The variation of the number of activated induction coils 20 allows a fine tuning of the average power. When the number of activated induction coils 20 has been changed from one to the next cycle, then the time of this cycle is about 1.5 s, since flicker and a limited boil-up and boil-down effect are created.

In the above example, the number of the induction coils 22, 24, 26 and 28 with the cooking zone is four. The set average power P for the cooking zone is 270 W. The maximum average power PM generated by the cooking zone at the predetermined frequency is 450 W, when all four induction coils 22, 24, 26 and 28 are activated. Thus, the percentage power PP is $$PP=P/PM=270\text{ W}/450\text{ W}=0.6=60\%.$$

The calculated number CN of induction coils 20 is given by the product of the percentage power PP and the number N of induction coils 22, 24, 26 and 28 within the cooking zone $$CN=4*PP=4*0.6=2.4.$$

The calculated number CN of 2.4 means that two of the induction coils 22, 24, 26 and 28 have to be activated the full time, while a further one of the induction coils 22, 24, 26 and 28 has to be activated 40% of the time. The timely part for activating the further one of the induction coils 22, 24, 26 and 28 corresponds with the fractional part of the calculated number CN.

The method for controlling the induction cooking hob with the plurality of induction coils according to the present invention allows an operation at a constant frequency, wherein all activated induction coils 22, 24, 26 and 28 are working at said same frequency.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 cooking surface
14 user interface
16 cookware
20 induction coil
22 first induction coil
24 second induction coil
26 third induction coil
28 fourth induction coil
P power
PM maximum power
PP percentage power
N number of induction coils within the cooking zone
CN calculated number of induction coils

The invention claimed is:

1. A method for controlling an induction cooking hob with a plurality of induction coils, wherein groups of induction coils are each configured to be covered by a respective piece of cookware to form a plurality of cooking zones, each having a set power and a set frequency, the method comprising the steps of:

setting, by a user, an average power (P) to be transferred to the piece of cookware on each of the plurality of cooking zones, determining a same frequency for the induction coils forming each of the plurality of cooking zones based on the set frequency of the cooking zone with a highest set power, estimating a maximum average power (PM) that occurs when all of the induction coils forming each of the plurality of cooking zones are activated with the determined same frequency, estimating a percentage power (PP) defined as quotient between the set average power (P) and the estimated maximum average power (PM), estimating a calculated number (CN) of induction coils defined as a product of a number (N) of the induction coils within each of the plurality of cooking zones and the percentage power (PP), alternately activating a minimum of the induction coils forming each of the plurality of cooking zones at the same determined frequency to heat each of the plurality of cooking zones, and wherein the minimum number of simultaneously activated induction coils within each of the plurality of cooking zones is defined by an integer value of the calculated number (CN),and wherein a temporal activation of a further one of the induction coils is defined by a fractional part of the calculated number (CN).

2. The method according to claim 1, characterized in that the induction coils of each of the plurality of the cooking zones are activated and deactivated according to a time schedule including a plurality of subsequent cycles, wherein each cycle corresponds with a combination of activated induction coils.

3. The method according to claim 2, characterized in that during each cycle at least the minimum number of simultaneously activated induction coils is activated.

4. The method according to claim 2, characterized in that during each cycle at most the minimum number of simultaneously activated induction coils and the further one of the induction coils is activated.

5. The method according to claim 2, characterized in that the number of cycles with the further one of the induction coils and the number of cycles without the further one of the induction coils corresponds with the fractional part of the calculated number (CN).

6. The method according to claim 2, characterized in that the time of a cycle following another cycle with the same number of activated induction coils is between 0.3 s and 0.6 s.

7. The method according to claim 2, characterized in that the time of a cycle following another cycle with a different number of activated induction coils is between 1.2 s and 1.8 s.

8. The method according to claim 2, characterized in that in subsequent cycles with the same number of activated induction coils the activated induction coils are cyclically interchanged.

9. The method according to claim 1, further comprising the step of adjusting the average power (P) by activating and deactivating of some the induction coils while maintaining the same frequency.

10. The method according to claim 9, wherein variation of the frequency is not used to vary the average power (P).

11. The method according to claim 1, wherein all of the activated induction coils operate at the same frequency.

12. An induction cooking hob (10) comprising:

a plurality of induction coils (20), wherein groups of induction coils (22, 24, 26, 28) are configured to be covered by a piece of cookware (16) and form a plurality of cooking zones, each having a set power and a set frequency;

a user interface used by a user to set an average power (P) to be transferred to the piece of cookware (16) on each of the plurality of cooking zones;

a controller electrically connected to the user interface and configured to:

determine a same frequency for the induction coils forming each of the plurality of cooking zones based on the set frequency of the cooking zone with a highest set power, estimate a maximum average power (PM) that occurs when all of the induction coils (22, 24, 26, 28) forming each of the plurality of cooking zones are activated with the same determined frequency, estimate a percentage power (PP) defined as quotient between the set average power (P) and the estimated maximum average power (PM), and estimate a calculated number (CN) of induction coils (22, 24, 26, 28) defined as a product of the number (N) of induction coils (22, 24, 26, 28) within each of the plurality of cooking zones and the percentage power (PP), and alternately activate a number of the induction coils (22, 24, 26, 28) forming each of the plurality of cooking zones at the same determined frequency to heat each of the plurality of cooking zones, wherein:

a minimum number of simultaneously activated induction coils (22, 24, 26, 28) within each of the plurality of cooking zones is defined by an integer value of the calculated number (CN), and a temporal activation of a further one of the induction coils (22, 24, 26, 28) is defined by a fractional part of the calculated number (CN).

13. The induction cooking hob according to claim 12, characterized in that the induction coils (22, 24, 26, 28) are arranged as a matrix on a cooking surface (12) of the induction cooking hob (10).

14. The induction cooking hob according to claim 12, characterized in that the induction coils (22, 24, 26, 28) on the cooking surface (12) of the induction cooking hob (10) have the same sizes.

* * * * *